United States Patent [19]

French et al.

[11] Patent Number: 4,620,395

[45] Date of Patent: Nov. 4, 1986

[54] VALVE GRINDING APPARATUS

[75] Inventors: Peter R. French, London; Roger Boore, Ewell, both of England

[73] Assignee: Valveserve Machines Limited, London, England

[21] Appl. No.: 623,565

[22] Filed: Jun. 22, 1984

[51] Int. Cl.[4] ..... B24B 15/02

[52] U.S. Cl. ..... 51/241 VS

[58] Field of Search ..... 51/241 R, 241 VS, 241 A, 51/241 S, 245, 241 B, 120

[56] References Cited

U.S. PATENT DOCUMENTS

| | | | |
|---|---|---|---|
| 2,318,854 | 5/1943 | Hall | 51/241 A |
| 2,777,263 | 1/1957 | Spence | 51/241 B |
| 3,069,819 | 12/1962 | Gilmore | 51/245 |
| 3,071,902 | 1/1963 | Curfman | 51/241 VS |
| 4,287,688 | 9/1981 | Jensen | 51/241 VS |

FOREIGN PATENT DOCUMENTS

| | | | |
|---|---|---|---|
| 155933 | 1/1953 | Australia | 51/241 VS |
| 733899 | 4/1943 | Fed. Rep. of Germany | 51/241 B |
| 1189932 | 3/1959 | France | 51/241 A |
| 124830 | 4/1959 | U.S.S.R. | 51/241 VS |

*Primary Examiner*—Roscoe V. Parker

*Attorney, Agent, or Firm*—Cushman, Darby & Cushman

[57] ABSTRACT

Apparatus for grinding valve seats comprises a grinding head 1 rotatably mounted on a supporting arm 2 bearing a drive motor 11 connected to rotate the head 1, and a support structure including a support block 15 with a cavity 15*a* through which the supporting arm 2 passes, the support structure further including a motor 35 driving the support block 15 through eccentric pin 38 to move the support block and the supporting arm in an orbital path, such that the grinding head performs rotational and orbital movement.

11 Claims, 12 Drawing Figures

VALVE GRINDING APPARATUS

The present invention relates to apparatus for grinding the seating surfaces of fluid control valves. The invention is especially valuable for the regrinding of valve seats in situ, that is to say the regrinding of the seats of valves connected in a pipe line without dismantling them from the pipe line.

One type of valve with which the machine according to the invention may be used is the so called wedge-gate valve. Such valves comprise a pair of opposed seatings surrounding the inlet and outlet ports of the valve the seatings facing one another across a narrow gap. A gate member can be introduced into the space between the seatings to seal off both ports and usually the seatings are arranged in planes set at a shallow divergent angle forming therefore a wedge shaped space between them. The closure member or gate is made of wedge shaped cross-section to fit into the wedge shaped space between the seatings. Opposite faces of the gate member seal against the opposed gate seatings. For a good closure to be achieved in such a valve it is clear that the mating surfaces must be accurately planar. While the preparation of the mating surfaces can be carried out relatively simply during manufacture of the valve in the factory while the valve parts are dismantled, it must be remembered that these valves frequently are required to operate in hostile environments and the seatings can become seriously contaminated or eroded. It therefore becomes necessary to re-surface the seatings from time to time and it is convenient if the re-surfacing can be carried out in situ. The re-surfacing of the valve gate is not difficult since this can be bodily removed and can be treated outside the body of the valve. However, to surface the valve seatings inside the body of the valve a machine is required which will reach into the interior of the valve body and present a grinding surface to the valve seatings. In the case of a wedge gate valve such as has been described above the grinding surface, which may be in the form of a rotating disc, will need to be presented towards each valve seating in turn in planes generally transverse to the pipe axis but at a shallow angle thereto, matching the angles at which the valve seatings are set.

Although in the above description reference has been made to a wedge gate valve and a wedge-shaped gate member, it will be appreciated that in some instances the gate member is not wedge-shaped and the valve may then be described as a parallel slide valve or a split gate valve.

In another form of valve which is frequently used a single seating is provided surrounding an aperture in a diaphragm which spans the body of the valve and a closure member is screwed down onto this seating through the wall of the valve directly opposite the seating. The whole mechanism carrying the closure member can be removed to expose the valve seating towards the aperture thus uncovered and a grinding mechanism can therefore be substituted for the closure operating mechanism and a grinding disc brought down into engagement with the seat thus exposed.

In both of the types of valve which have been described it would be unsatisfactory merely to expose each valve seating to a rotating disc rotating on a fixed axis since this could lead to "tracking" or the formation of score marks or grooves in the surface of the seating, which would impair the operation of the valve. Accordingly, it is an object of this invention to provide a mechanism which will not only provide a grinding mechanism which can be introduced into a valve body to grind the valve seating therein but which will in so doing apply to the grinding surface an orbiting motion which will avoid the danger of tracking above referred to.

Another desirable feature of such a machine is that the grinding mechanism should be removable from the valve and replaceable therein in an accurately determined position so that the progress of the work can be examined from time to time and interchange of grinding surface materials effected as may be required. A further object of this invention is to provide an arrangement enabling this to be done.

According to this invention in one aspect an apparatus for grinding valve seats and like surfaces comprises a grinding head rotatably mounted on a supporting arm, drive means for said grinding head also mounted on said supporting arm and a support structure carrying said supporting arm, said support structure including means for imparting a cyclic motion to said supporting arm in a plane substantially parallel to the plane of said grinding head.

According to the invention in one of its aspects said supporting arm is carried on said support structure on slide means providing freedom of movement of said arm in two orthogonal directions in said plane and including drive means for driving said arm in a cyclic path in said plane.

According to a preferred feature of the invention said drive means for driving said arm includes a drive motor associated with said support structure and an eccentric drive coupling said motor to said slide means.

According to another preferred feature of the invention, said supporting arm is adjustably mounted with respect to said slide means to enable the reach of said arm to be varied.

According to yet another feature of the invention said support structure is pivotally mounted on a base structure and means are provided to enable the posture of said support structure on said base structure to be varied. In a preferred form of this feature of the invention the support structure is demountably attached to said base structure by means enabling said support structure to be relocated on said base structure to restore the support structure to said required posture.

According to the invention in one of its forms said supporting arm comprises a pair of support tubes, a grinding head support mechanism carried by said support tubes at one end thereof, a drive motor carried by said support tubes at the other end thereof, and a chain and sprocket drive coupling said drive motor to said grinding head, the forward and return runs of said chain passing through said support tubes.

According to a preferred feature of the invention in this last mentioned form said support tubes are mounted for longitudinal movement through a bearing block and said bearing block is mounted for movement in a direction transverse to said support tubes in a support body, said support tubes are attached to a crank block and a drive motor mounted on said support body is coupled to said crank block through an eccentric so as to impart a planetary motion to said crank block and thereby to said supporting arm.

According to the invention in another form said supporting arm comprises a main beam adjustably supported on a crank block, a support structure for said beam mounted on slide means providing freedom of movement of said beam in two orthogonally related directions, drive means for driving said crank block in a cyclic path to impart a cyclic motion to said supporting beam in a plane containing said two orthogonally related directions, a grinding head rotatably mounted on one end of said beam, drive means on the other end of said beam and a connecting rod connecting said drive means to said rotatable driving head.

In a modification of the last named mechanism said drive means is connected to said grinding head by a chain and sprocket drive.

In another aspect the invention resides in an apparatus for grinding valve seats and like surfaces comprising a grinding head mounted on a supporting shaft, drive means coupled to and mounted to move with said supporting shaft, a mounting body for said supporting shaft said mounting body including a tubular arm enclosing said shaft, and mounting means for said tubular arm, said shaft being supported within said mounting body eccentrically with respect to said mounting means whereby rotation of said tubular arm within said mounting means will generate an orbital gyration of said shaft about the axis of said mounting means.

In an arrangement of the kind last defined said mounting body may comprise a pair of tubular arms one within the other one of said arms being eccentrically mounted within the other, said shaft being mounted eccentrically within the inner of said tubular arms, said tubular arms being rotatable one within the other whereby the eccentricity of said shaft with respect to said mounting means may be varied. An apparatus of this kind may be provided with driving means coupled to said tubular arm or arms to rotate the arm or arms with respect to said mounting means whereby to generate said orbital gyration of said shaft.

In order that the invention may be more clearly understood several embodiments thereof will now be described with reference to the accompanying drawings in which.

Figure 5A:
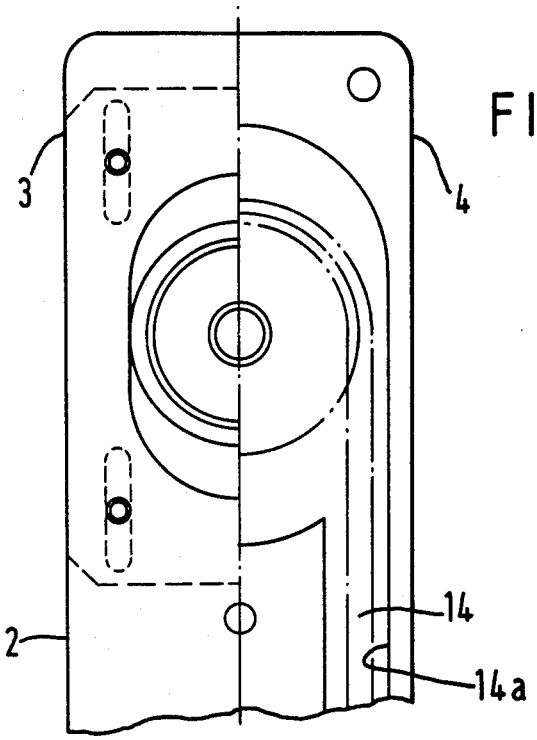

FIG. 5*a* is a front view and

Figure 4:
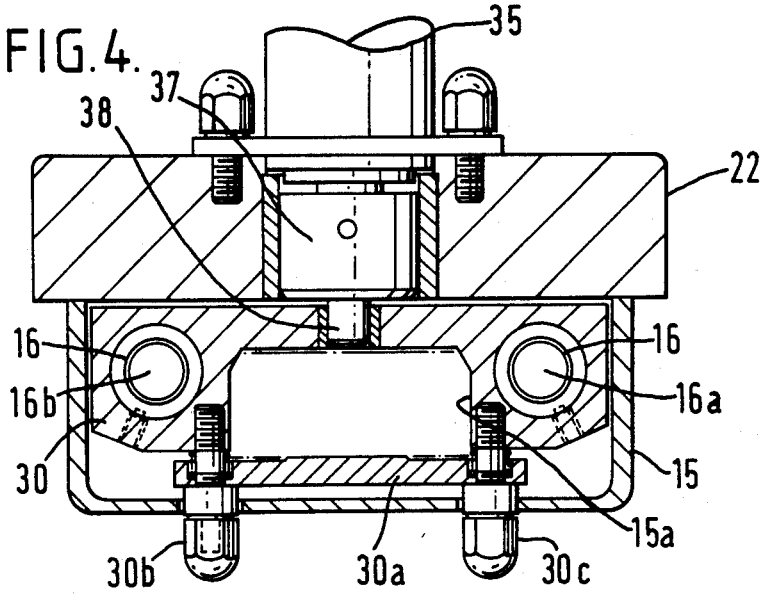
FIG. 4 is a cross-section on the line IV—IV of FIG. 3.
Figure 5C:
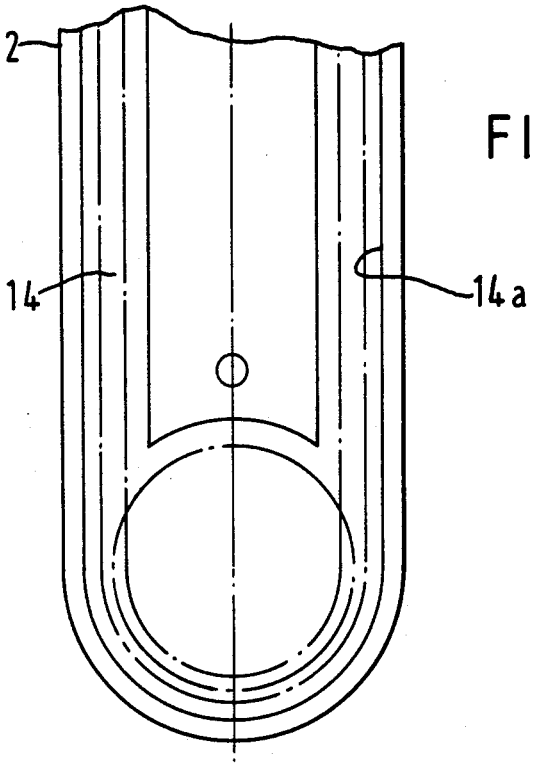
Figure 5B:
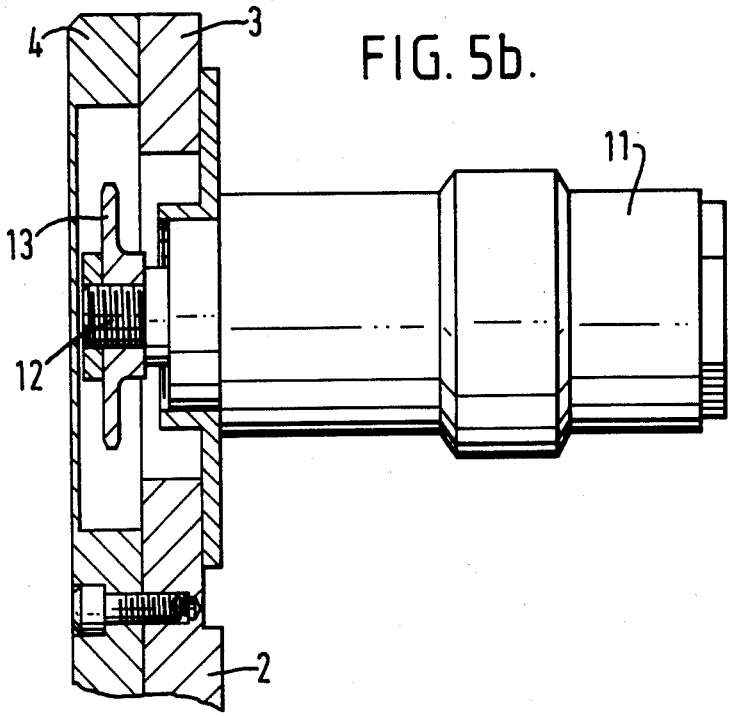

FIG. 5*b* is a side elevation in section of the upper part of a support arm for use in the machine of FIGS. 1–4;

FIG. 5*c* is a front view and

Figure 5D:
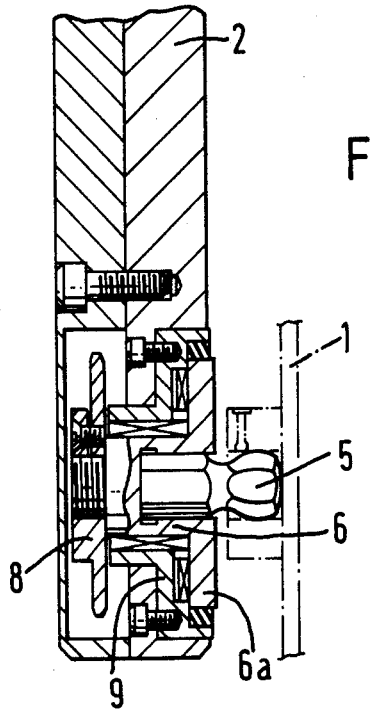

FIG. 5*d* is a side view in cross-section of the lower part of the support arm of FIGS. 5*a* and 5*b;*

FIGS. 5*e* and 5*f* show a further embodiment of the invention.

Figure 6:
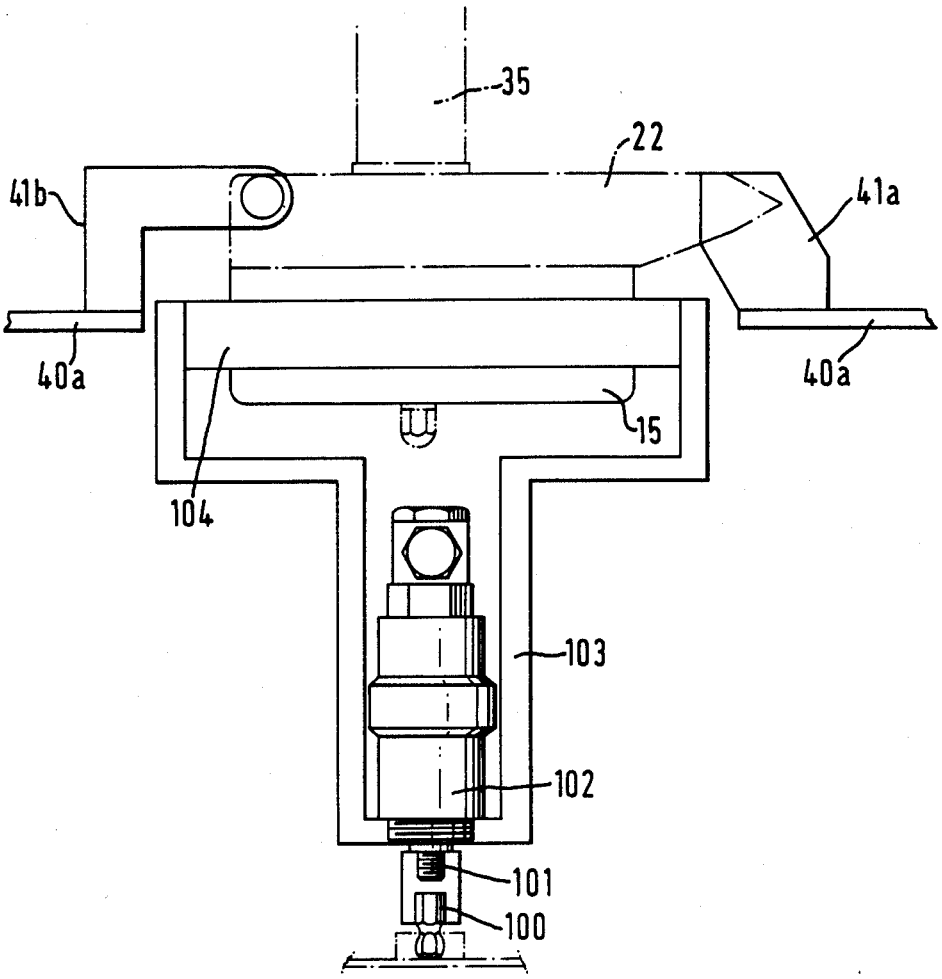
Figure 7:
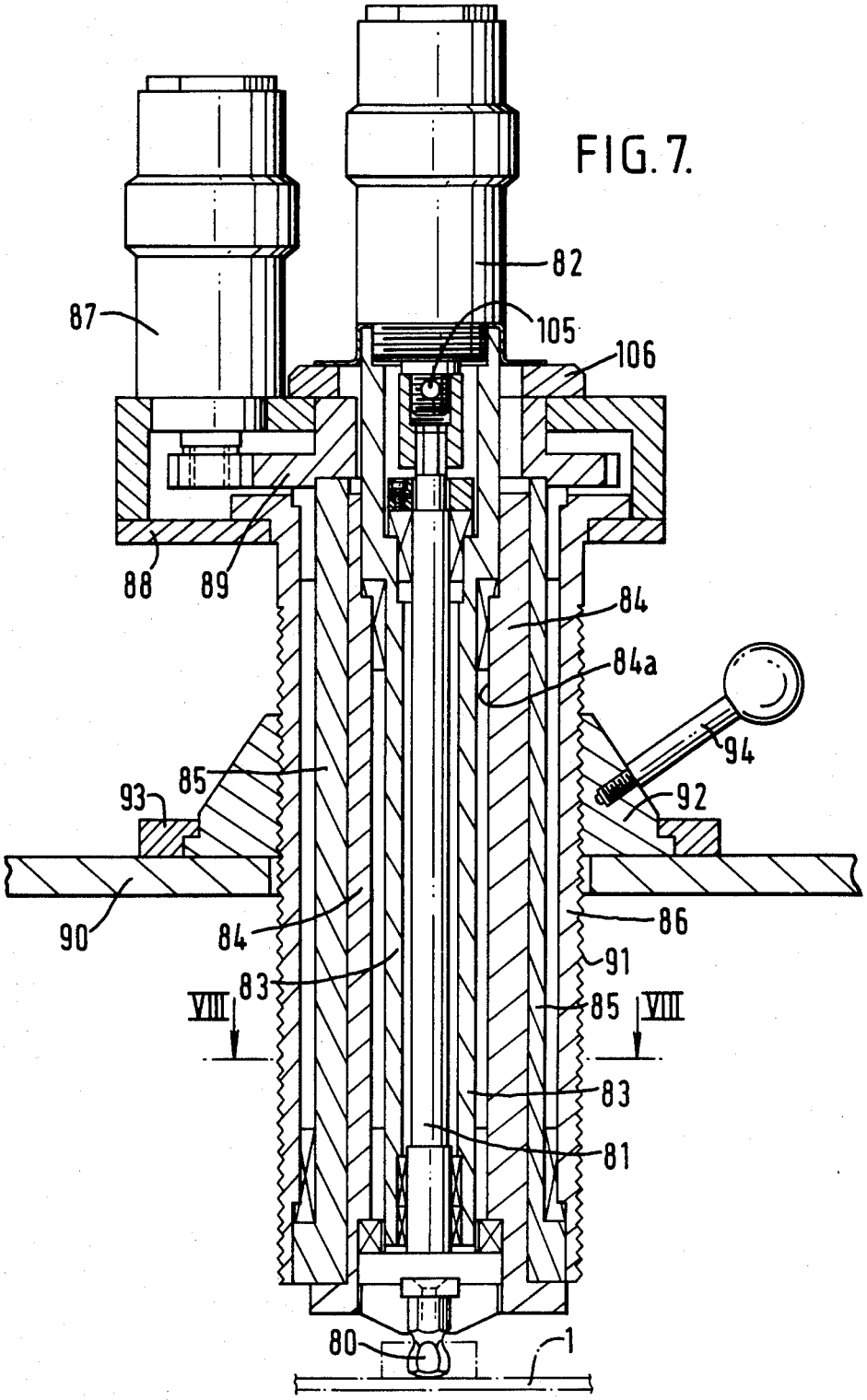
Figure 8A:
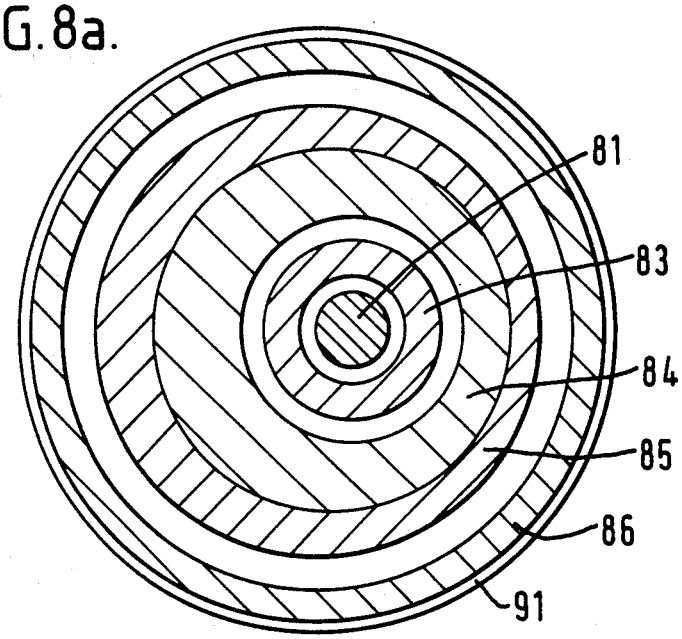
Figure 8B:
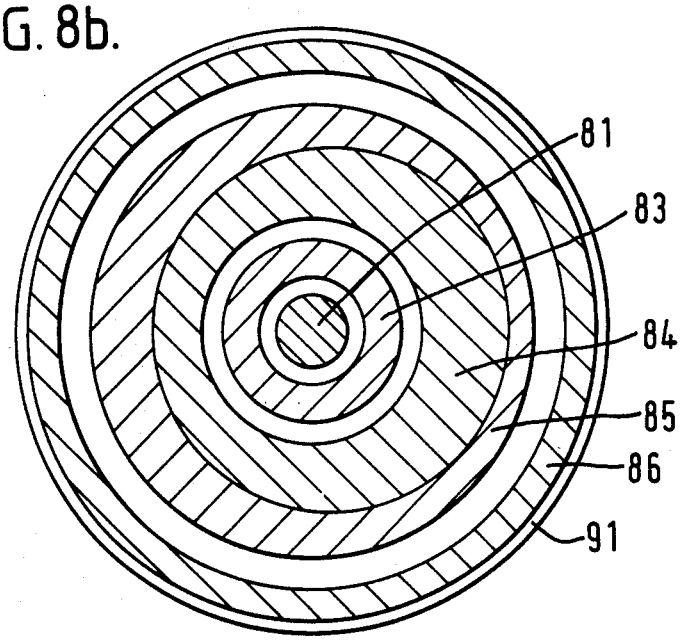

FIG. 6 is a side elevation of the machine of FIGS. 1–4 in an alternative mode of use;

FIG. 7 is a longitudinal cross-sectional view of a further machine according to the invention; and FIGS. 8*a* and 8*b* are a transverse cross-section on line VIII—VIII of the machine of FIG. 7.

Referring first to the form of apparatus shown in FIGS. 1 to 5 a grinding disc, shown in chain dotted outline in FIG. 5*d* at 1 is mounted on the lower end of a supporting arm 2 consisting of a back bar 3 and a front bar 4. The grinding disc 1 is carried on an hexagonal stub shaft 5 of a kind which allows a limited angular movement of the grinding disc 1 with respect to its axis of rotation. The stub shaft 5 is mounted on a bearing shaft 6 which is rotatably mounted in the front wall of back bar 3 of the supporting arm. The shaft 6 carries a sprocket 8. The shaft 6 moreover has a flange 6*a* which is backed by a thrust bearing ring 9. The assembly so far described will be seen to enable the grinding disc 1 to be rotated by a drive applied to sprocket 8 while axial pressure is applied through the thrust bearing 9. At the upper end, the arms 3 and 4 carry a drive motor 11 on the shaft 12 of which there is mounted a sprocket 13. A chain drive 14 (FIGS. 5*a* and 5*c*) which runs in a channel 14*a* formed between the front and back bars 3 and 4 couples the sprocket 13 to sprocket 8 so that the motor 11 may apply a rotary drive to the disc 1.

The motor 11 may be of any convenient kind such as an electric, a pneumatic or a hydraulic motor, preferably having a variable speed capability.

The supporting arm 3, 4 etc. passes through a support block 15. The support block 15 has a central cavity 15*a* through which the supporting arm 3, 4 passes. Within the cavity 15*a* is a crank block 30. The supporting arm 3,4 is clamped in the crank block 30 by means of a clamping plate 30*a* and two clamping screws 30*b* and 30*c*. The back edges of the back bar 3 are chamfered so that the supporting arm will engage firmly in a channel formed in the crank block 30 to receive it, and may be adjusted to whatever height is required to bring the grinding disc 1 into the correct location with respect to the valve seat to be ground. The crank block 30 is supported on two vertical shafts 16*a*, 16*b* mounted in the support block 15 on four linear bearings 16 which may be of the recirculating ball kind so that the supporting arm structure as a whole can move through the block 15 but is accurately guided in the direction of the shafts 16*a* and 16*b*.

Above and below the cavity 15*a* the block 15 carries projections 17*a* and 17*b* respectively. These projections are dimensioned so as to fit freely into apertures 20 and 21 in a support body 22. The projections 17*a* and 17*b* are provided with bores to receive cross-shafts 25 and 26 which are slidable in linear bearings 27 in the projections 17*a* and 17*b*. The shafts 25 and 26 are located in the support body 22 by means of set screws 28 (FIG. 2) which engage recesses in the respective shafts. Thus the support block 15 is freely movable in a direction transverse to that of the supporting arm 3, 4 and is accurately guided in this transverse direction by the bearings 27 which can be, as bearings 16, of the recirculating ball type.

Figure 1:
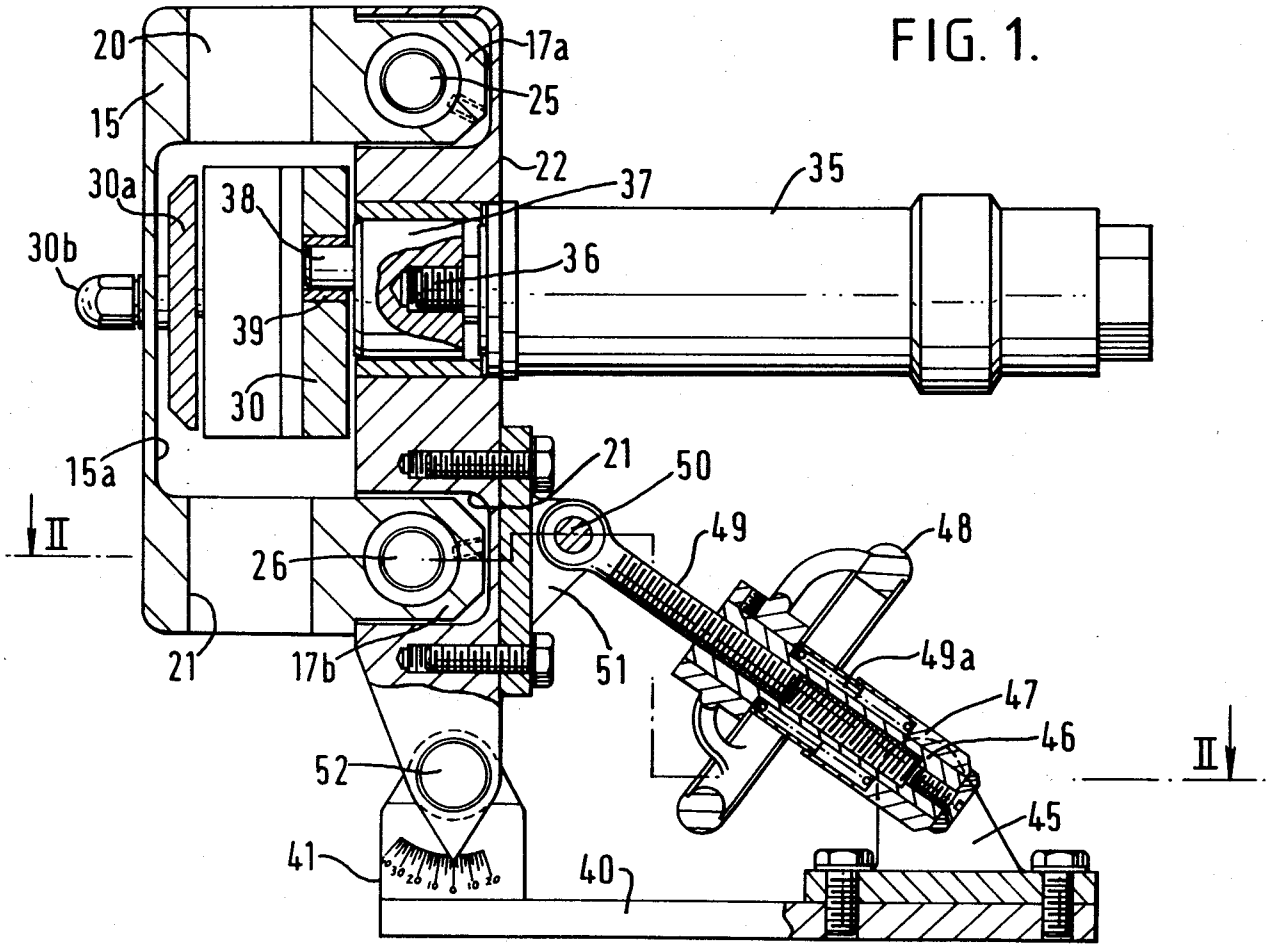
FIG. 1 is a side elevation in cross-section of a support structure for a machine according to the invention.

Mounted in the support body 22 there is a further drive motor 35 (FIGS. 1 and 4). The shaft 36 of motor 35 carries a crank shaft 37 on the end face of which is formed an eccentric drive pin 38. The drive pin 38 engages in a bearing aperture 39 in the crank block 30. It will now be seen that the motor 35 can drive the crank block 30, and with it the whole structure supported by arms 3 and 4 in an orbital path with respect to the support body 22. Vertical components of movement will be accommodated by bearings 16 running on shafts 16*a* and 16*b* and horizontal components of movement by bearings 27 running on the cross-shafts 25 and 26.

Figure 2:
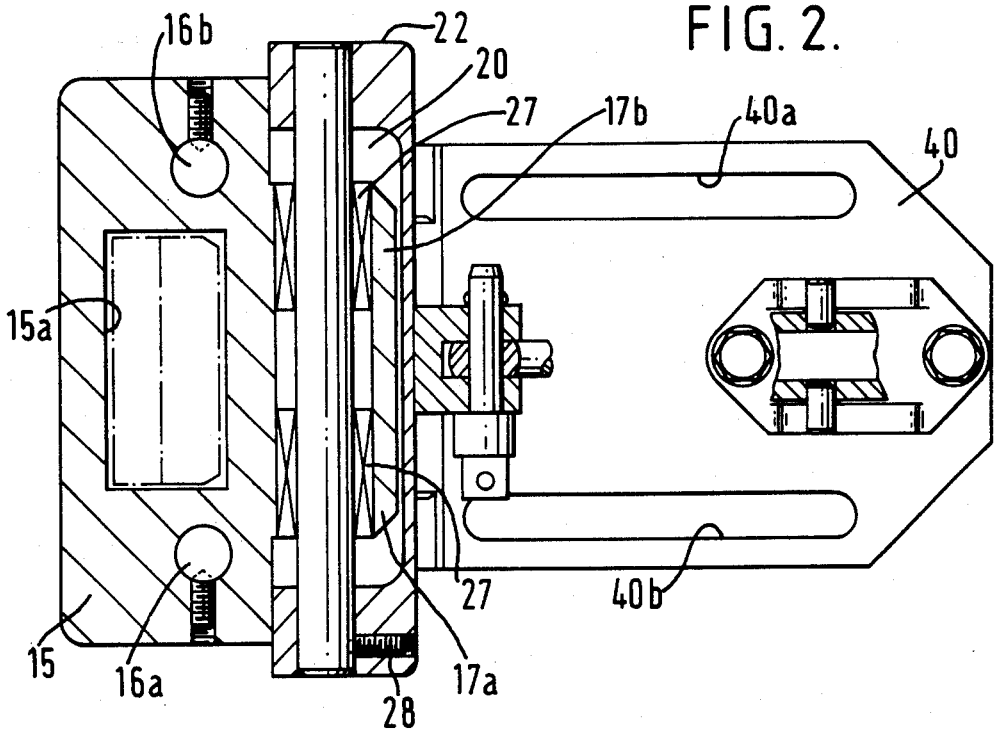
FIG. 2 is a plan view of the support structure of FIG. 1, also in cross-section on the line II—II of FIG. 1.

The whole structure so far described is mounted on a base structure shown in FIGS. 1 and 2. This base structure comprises a base plate 40 which will be suitably designed to fit upon the flange of a valve body the interior seatings of which are to be ground. The plate 40 can be designed so that the structure can be fitted to a wide variety of valves. It is shown provided with two slots 40*a* and 40*b* by which it can be clamped to a sub-plate (not shown) in an adjustable manner. Secured to the base plate 40 is a mounting block 41 which is provided with an upstanding portion 42 (FIG. 3) dimensioned so as to fit within the space between two lugs 43 and 44 projecting from the bottom corners of the support body 22. The projection 42 and the lugs 43 and 44 are bored to receive pivot pins 52 by which the support body 22 is pivotally mounted on the mounting block 41. The pivot pins 52 are preferably of a retractable design located within the bores through lugs 43 and 44 by means of spring detents in known manner so that they may be removed to enable the support block 22 and all the structure it supports to be removed from the base structure for a purpose which will be later described.

Spaced behind the mounting block 41 on the base plate 40 is a bracket 45. Mounted on trunnions located in upstanding webs on this bracket is a bush 47 in which is mounted a screw sleeve 46. The screw sleeve 46 is operated by a hand wheel 48. Engaged within the screw sleeve 46 is a screw 49 the outer end of which is pivoted at 50 to a projection 51 which forms part of the support body 22. Operation of the hand wheel 48 draws the pin 50 to the right against the action of a spring 49*a* or to the left, swinging the support structure including the supporting arm 3, 4 and with it the grinding head and related structure, about the pivot 52 and its counterpart on the other side of mounting block 41 so as to set the mechanism at the desired angle for accurate engagement with the valve seat surface to be ground. It will be noticed that the screw and sleeve assembly 49, 47 is set up at an angle such that it operates at all times in a direction substantially tangential to the arc of movement of the pivot 50. Adjustment of the supporting arm 3, 4 in the crank block 30 enables the reach of the arms to be adjusted so that the grinding disc 1 will be properly positioned in relation to the axis of the valve port to be ground.

The operation of this machine will now be apparent. With the base plate 40 properly mounted on the flange of a valve from which the top hamper has been removed, the supporting arm 3, 4 properly adjusted in the crank block 30, and the hand wheel 48 set to give the correct angle of the grinding disc 1, motor 11 can be set in motion to drive disc 1 via the chain and sprocket drive. At the same time motor 35 is started. Motor 35, which may also be an electric, pneumatic or hydraulic motor, has an operating speed which is only a small fraction of the speed required for the drive of grinding disc 1. It thereby produces a slow nutating motion of the grinding arm over a small excursion around a central axis. Clearly the shaft 37 can be chosen to provide an appropriate eccentricity for the job in hand. A selection of such eccentric drives will be provided to enable a range of valve sizes to be accommodated.

Hand wheel 48 can now be used to apply a pressure on spring 49*a* which in turn will apply a cutting pressure on grinding disc 1. Spring 49*a* will also compensate for any small error of initial angle setting with hand wheel 48 and give a constant pressure of cut.

From time to time during a grinding operation it will be necessary to inspect the valve seat surface and the abrasive coating on grinding disc 1 and it will sometimes be decided to change the abrasive layer either to renew it or substitute a different grade of abrasive. To enable this to be done the support body 22 can be disconnected from the adjusting screw 49 by removing pin 50, the dowel pin 52 in lug 44 and its counterpart in lug 43 withdrawn and the whole grinding mechanism removed from the supporting base. The machine can then be re-assembled into its original attitude with respect to base plate 40 and therefore with respect to the valve body merely by re-engaging the dowels in the mounting block 42 through the lugs 43 and 44, re-engaging pin 50 to reconnect the support body 22 with the hand wheel 48 and the whole arrangement thus restored to its previously set-up position.

Other forms of mechanism can be employed to transmit a drive from the outer end of the support arm to the grinding disc at its inner end. For example the main supporting arm may be in the form of a beam at the top end of which is mounted the drive motor 11 as before. In place of the sprocket 13, however, there is provided an eccentric drive mounted on the shaft of motor 11 which drives the hexagonal stud axle carrying the grinding disc 1 by way of a connecting rod engaging an eccentric drive at the lower end of the supporting arm.

In another construction as shown in FIGS. 5*e* and 5*f* the beam 3, 4 may be replaced by a pair of tubular arms 3' and 4', spaced apart and clamped in the bearing block in parallel relationship. These tubes carry at their upper ends a head member, which carries the drive motor and contains a sprocket as in the embodiment shown in FIGS. 1 to 5. At their lower ends the tubular members carry a mounting for the grinding disc and a sprocket 8 as in FIGS. 1 to 5. The sprockets are coupled by a chain drive as before, the forward and return runs of the chain passing through respective ones of the tubular members.

Figure 3:
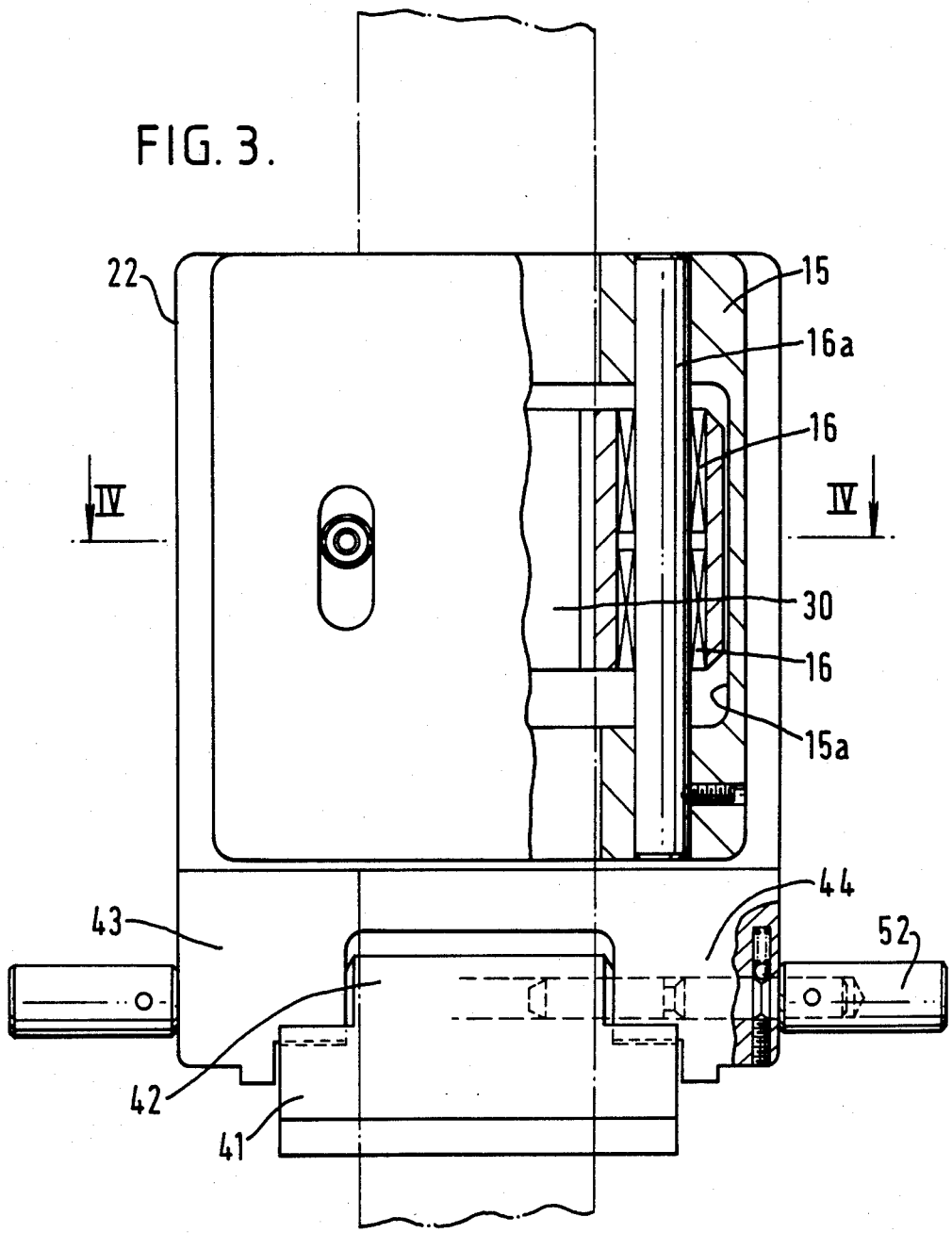
FIG. 3 is a front view, partly in cross-section, of the support structure of FIGS. 1 and 2.

In this embodiment the tubular members may be supported in linear bearings mounted in the upper and lower parts of the support block 15 thus replacing the shafts 16*a* and 16*b* of FIGS. 3 and 4.

The mechanisms so far described are primarily intended for the grinding of valve seats in gate valves of the kind in which the valve seatings are in planes substantially perpendicular to the axis of the pipes which the valve connects, being at slightly divergent angles in the case of a so-called wedge gate valve. In FIG. 6 a form of structure is shown by means of which the machine of FIGS. 1 to 5 may be adapted to the grinding of valve seats of the kind referred to above in which a valve seat is presented with its face towards the top opening of the valve body when the top hamper or operating mechanism of the valve is removed.

For this purpose a structure is required in which the grinding disc is presented in an attitude substantially normal to the arm on which it is supported. In the arrangement now to be described the grinding disc 1 is mounted as before on an hexagonal stub shaft 100 which is carried on the end of a driving shaft 101. At its upper end the shaft 101 is driven by a drive motor 102 equivalent to the drive motor 11 of FIG. 5. The drive motor 102 is carried on a frame 103 which in turn is mounted on a block 104 secured to the bearing block 30 of FIGS. 1 to 5 in place of supporting arm 3, 4. To operate the machine in this mode the support structure 15, 22 etc. is removed from the base plate 40 by withdrawing pins 50 and 52 as above described and mounted instead on a base-place 40*a* by means of brackets 41*a* and 41*b*. With the base plate 40*a* mounted on the flange of the valve the motor 102 carrying grinding disc 1 is supported inside the valve body with the lower face of the grinding disc presented towards the valve seat. When the motor 102 is started up the motor 35 is also started and the support structure carrying motor 102 and the grinding disc is orbited in the same manner as above described for the supporting arm 3, 4 in FIGS. 1 to 5.

An alternative form of machine according to the invention is shown in FIGS. 7 and 8*a* and 8*b*. In this construction, which is intended for grinding seat valves of the kind referred to in the embodiment of FIG. 6, the grinding disc 1 is again mounted on a hexagonal stub shaft 80 which is carried on the end of a driving shaft 81. At its upper end the shaft 81 is driven by a drive motor 82 equivalent to the drive motor 11 of FIG. 5. The drive motor 82 is carried on a tubular support arm 83 which is concentric with shaft 81 and within which the shaft 81 is journalled at its upper and lower ends. The supporting arm 83 is mounted in a tubular arm 84 which has an eccentric bore 84*a* in which the shaft 81 and its supporting arm 83 are mounted. The tubular arm 84 is in turn mounted within the eccentric bore of a further sleeve 85. Surrounding the whole is an outer casing 86 which is keyed to the base plate 90 to prevent rotation relative thereto. Suitable bearings are provided at the upper and lower ends between the shaft 81 and the arm 83, between the arm 83 and the tubular arm 84, and between the sleeve 85 and the outer casing 86.

At the upper end of the casing there is mounted a drive motor 87 equivalent to the drive motor 35 of FIG. 3. The shaft of motor 87 carries a pinion 88 which engages a gear 89 onto which the sleeve 85 is mounted.

In order to prevent rotation of the motor 82 and its mounting 83 within the tubular arm 84, and to provide a reaction force against which the motor can operate to turn the grinding disc 1 a cross-pin 105 is provided projecting radially outwardly from the motor mounting 83 and engaging into recesses formed in the collar 106 which is attached to the body 88. The recesses in collar 106 are made wide in extent to accommodate variations of the relationship between the two eccentrically bored tubes 84 and 85 employed to vary the eccentricity of motor 82 as above described.

The operation of the machine will now be clearly apparent. When motor 87 is started sleeves 85 and 84 are driven in a rotary motion and by virtue of the eccentricity with which the shaft 81 and its driving motor 82 are mounted within the tube 84 the shaft 81 its driving motor 82 and the grinding disc 1 will be driven in an orbit around a central axis. Meanwhile the motor 82 drives the grinding disc 1 and as before the speed at which disc 1 is driven is many times that at which the support structure 84, 85 is driven.

By virtue of the provision of the two eccentrically bored tubes 84 and 85 it is possible to vary the eccentricity of the mounting of shaft 81 with respect to the outer casing 86. Thus the eccentricity of 84 within 85 can be made to off-set the eccentricity of the motor mounting 83 within the tube 84 so that the shaft 81 is concentric with casing 86 as in FIG. 8*b*. Alternatively, the two tubes can be rotated one within the other so that the eccentricities are additive and a maximum excursion of the motor shaft around the central axis of the machine will then take place, as shown in FIG. 8*a*.

As in the machine previously described the whole is mounted on a base plate 90. The outer casing 86 is provided on its outer surface with a screw thread 91 which is engaged through a threaded collar 92 which is located on the base plate 90 by a locating ring 93. An operating handle 94 enables the collar 92 to be turned to raise or lower the whole structure on its screw thread in order to adjust it in relation to the valve seat being ground and to advance it as material is removed.

If as in the previous embodiment it is desired to remove the equipment to examine the grinding surfaces the locating ring 93 can be disengaged from base plate 90 and the apparatus withdrawn. By virtue of the location of the equipment within the collar 92 and the location of the lower face of the collar 92 on base plate 90, the apparatus can be restored to its original position with accuracy.

It will be apparent that many variations of the structures described are possible and that machines according to the invention are capable of a wide variety of uses. For example the machine as adapted in the manner described with reference to FIG. 6 or the embodiment described with reference to FIGS. 7 and 8 can be used not only for grinding flat valve seats in the manner described but also for trimming the conical surfaces of such seats to compensate for the change in diameter brought about by the grinding operation. Similarly the machine can be adapted, by the use of suitable mounting jigs to grind the faces of the gates of gate valves and wedge gate valves outside the valves from which they have been removed so that the entire servicing of a valve can be carried out "on site".

Moreover, it will be appreciated that the structures described will give, when properly adjusted an even pressure on the grinding disc, since the planetary motion is planar and the structure can be made sufficiently rugged to ensure an accurate grinding motion over a wide range of sizes and types of valve.

We claim:

1. Apparatus for grinding valve seats and like surfaces comprising a grinding head rotatably mounted on a supporting arm, drive means for rotating said grinding head also mounted on said supporting arm and a support structure carrying said supporting arm on slide means providing freedom of movement of said arm in two orthogonal directions in a plane substantially parallel to the plane of rotation of said grinding head, said support structure including drive means for imparting a cyclic motion to said supporting arm which motion is in said plane substantially parallel to the plane of rotation of said grinding head and has components in said two orthogonal directions.

2. Apparatus as claimed in claim 1 wherein said drive means for imparting a cyclic motion to said arm includes a drive motor associated with said support structure and an eccentric drive coupling said motor to said slide means.

3. Apparatus as claimed in claim 1 wherein said supporting arm is adjustably mounted with respect to said slide means to enable the reach of said arm to be varied.

4. Apparatus as claimed in claim 1 wherein said support structure is pivotally mounted on a base structure and means are provided to enable the posture of said support structure on said base structure to be varied.

5. Apparatus as claimed in claim 4 wherein the support structure is demountably attached to said base structure by means enabling said support structure to be relocated on said base structure to restore the support structure to said required posture.

6. Apparatus as claimed in claim 1 wherein the supporting arm comprises a pair of support tubes, a grinding head support mechanism being carried by said support tubes at one end thereof, a drive motor being carried by said support tubes at the other end thereof, and a chain and sprocket drive coupling said drive motor to said grinding head, the forward and return runs of said chain passing through said support tubes.

7. Apparatus as claimed in claim 6 wherein the support tubes are mounted for longitudinal movement through a bearing block and said bearing block is mounted for movement in a direction transverse to said support tubes in a support body, said support tubes are attached to a crank block and a drive motor mounted on said support body is coupled to said crank block through an eccentric so as to impart a planetary motion to said crank block and thereby to said supporting arm.

8. Apparatus as claimed in claim 1 wherein the supporting arm comprises a main beam adjustably supported on a crank block, on which acts said drive means imparting a cyclic motion, the grinding head being rotatably mounted on one end of said beam, and the drive means for rotating the grinding head being mounted on the other end of said beam.

9. Apparatus as claimed in 8 wherein said drive means is connected to said grinding head by transmission means selected from a chain and sprocket drive, and a connecting rod.

10. Apparatus for grinding valve seats and like surfaces comprising a grinding head rotatably mounted on a supporting arm, drive means for rotating said grinding head also mounted on said supporting arm, and support structure including means for imparting a cyclic motion to said supporting arm which motion is in a plane substantially parallel to the plane of rotation of said grinding head, wherein the supporting arm comprises a pair of support tubes, a grinding head support mechanism being carried by said support tubes at one end thereof, a drive motor being carried by said support tubes at the other end thereof, and a chain and sprocket drive coupling said drive motor to said grinding head, the forward and return runs of said chain passing through said support tubes, and wherein the support tubes are mounted for longitudinal movement through a bearing block and said bearing block is mounted for movement in a direction transverse to said support tubes in a support body, said support tubes are attached to a crank block and a drive motor mounted on said support body is coupled to said crank block through an eccentric so as to impart a planetary motion to said crank block and thereby to said supporting arm.

11. Apparatus for grinding valve seats and like surfaces comprising a grinding head rotatably mounted on a supporting arm, drive means for rotating said grinding head also mounted on said supporting arm, and including support structure for imparting a cyclic motion to said supporting arm which motion is in a plane substantially parallel to the plane of rotation of said grinding head, wherein imparting means is pivotally and demountably mounted on a base structure, means are provided to enable the posture of said support structure on said base structure to be varied and said demountable attachment to said imparting means is by means enabling said support structure to be relocated on said base structure to restore the support structure to said required posture, and the supporting arm comprises a main beam adjustably supported on a crank block, said main beam being mounted to the support structure on slide means providing freedom of movement of said beam in two orthogonally related directions, said cyclic motion imparting drive means driving said crank block in a cyclic path to impart a cyclic motion to said beam in a plane containing said two orthogonally related directions, the grinding head being rotatably mounted on one end of said beam, and the drive means for rotating said grinding head being mounted on the other end of said beam.

* * * * *